US006223931B1

(12) United States Patent
Strube et al.

(10) Patent No.: US 6,223,931 B1
(45) Date of Patent: May 1, 2001

(54) CLOSURE END MADE OF SHEET

(75) Inventors: Lutz Strube, Cremlingen; Peter Hoft, Braunschweig; Dieter Heinecke, Wendeburg, all of (DE)

(73) Assignee: Schmalbach-Lubeca AG (DE)

( * ) Notice: Subject to any disclaimer, the term of this patent is extended or adjusted under 35 U.S.C. 154(b) by 0 days.

(21) Appl. No.: 09/398,885

(22) Filed: Sep. 20, 1999

Related U.S. Application Data

(62) Continuation of application No. 09/188,944, filed on Nov. 10, 1998, now Pat. No. 5,987,956, which is a continuation of application No. 08/411,739, filed as application No. PCT/DE93/00958 on Oct. 8, 1993, now Pat. No. 5,832,770.

(51) Int. Cl.[7] ..... B65D 23/00
(52) U.S. Cl. ..... 220/609; 220/608
(58) Field of Search ..... 220/609, 608; 215/375

(56) References Cited

U.S. PATENT DOCUMENTS 3,441,170 * 4/1969 Khoury .
3,979,009 * 9/1976 Walker ..... 220/609
4,177,746 * 12/1979 Lee, Jr. et al. ..... 220/609
4,832,223 * 5/1989 Kalenak et al. ..... 220/608
5,234,126 * 8/1993 Jonas et al. ..... 220/609
5,452,815 * 9/1995 Hsiung ..... 220/609
5,492,245 * 2/1996 Kalkanis ..... 220/609
5,664,695 * 9/1997 Young et al. ..... 220/609

* cited by examiner

*Primary Examiner*—Joseph M. Moy
(74) *Attorney, Agent, or Firm*—Duane, Morris & Heckscher LLP

(57) ABSTRACT

A closure end is provided, particularly made of sheet material for beverage cans, in which an annular fringe region is radially coupled between the central panel portion and a radius of curvature coupled to a core groove with an inner leg. The central panel portion is squeezed such that material is displaced (flows) from the fringe region in a substantially radial outward direction towards the radius of curvature. The squeezing is accomplished by a coining tool having a coining surface operable to contact the closure end. The closure surface is pressed against the closure end causing the thickness of the sheet material of the closure end to be reduced in the annular fringe region. The reduction in thickness gradually decreasing in the direction of the radius of curvature. The material displaced by the squeezing flowing towards the radius of curvature. A ring tool which is finger like in cross section can be used to exert pressure on the core groove during or after the squeezing thereby causing the inner leg of the core groove to move towards a more vertical orientation.

11 Claims, 2 Drawing Sheets

CLOSURE END MADE OF SHEET

CROSS REFERENCE TO RELATED APPLICATION

This application is a continuation of Ser. No. 09/188,944 filed Nov. 10, 1998, now U.S. Pat. No. 5,987,956, which is a continuation of Ser. No. 08/411,739 filed May 17, 1995 now U.S. Pat. No. 5,832,770, which is a 371 of PCT/DE93/00958 filed Oct. 8, 1993.

BACKGROUND OF THE INVENTION

1. Field of the Invention

The present invention relates to a process for further treating a closure end made of sheet, particularly a folding end for beverage cans or the like. The tool for carrying out the process is also concerned.

2. Prior Art

Such an end is known from U.S. Pat. No. 3,441,170, where the radius of curvature itself is reduced in thickness from the inner side of the end thereby forming a bead ("coined bead") . In this way, kind of a joint is created between the inner leg of the groove and the central panel portion to restrict the bulging of the end to the central panel portion so as to reduce the tensile forces acting radially inwardly upon the core wall of the end. At this joint (coined bead), the central panel portion bulging more strongly under the increased internal pressure, is pivoted to the core wall such that the bulging does not affect or only affects slightly the latter as regards its vertical orientation.

EP 88 968 A1 discloses a similar measure in which, starting from the radially inner edge of the radius of curvature', the end sheet is externally deformed over an area of the radius of curvature' by pressing power, so that material of the end flows radially inwardly and outwardly from this radius of curvature region. The deformation region forms a flattening on the outer side of the radius of curvature', the major portion of the flattening being disposed in a plane perpendicular to the end axis or in a conical plane inclined outwardly and downwardly. This also serves for improving the resistance of the end to bulging. Owing to the flow of the material radially inwardly, compressive strain is applied to the outwardly bulged central panel portion thereby forming a free bulging ("free doming of central panel"), while the material flowing radially outwardly pivots permanently the inner leg of the groove Ushaped in cross-section from its original, inclined position into a position which is more cylindrical or parallel to the end axis ("permanent deflection of inner leg"). In the two known measures, the region deformed by coining ("coining") is simultaneously hardened by cold working ("work hardened") . Both prior art solutions strive to obtain an enlarged bulging of the central panel portion ("doming") . However, if a filled can provided with such a considerably bulged end is pasteurized, for example (it being placed upside down in this case), the resulting bulging will cause the can s t o tip and fall over.

SUMMARY OF THE INVENTION

It is the object of this invention to modify an end by a process in such a way that the bulging of the end center can largely be reduced and nevertheless material from the end edge portion can be displaced in controlled fashion to increase the resistance to pressure.

In this connection, the annular fringe region which is formed in the further treatment accompanied by a reduction in thickness, is clearly positioned radially inside the actual radius of curvature'. This means that almost no material is displaced into the central panel portion but out of its edge portion, via the radius of curvature and (almost exclusively) into the radially inner leg of the U-shaped core groove. This displacement process is achieved, above all, by the angle which is formed and defined by the coining areas actuating upon the fringe-like region. This angle is defined between the coining areas of the coining tool or coining die actuating externally upon the end and a plane extending perpendicularly to the end axis. In this connection, the coining area of the lower coining tool or coining die is preferably parallel to this plane extending perpendicularly to the end axis, which means that said angle also exists between the two coining areas. This angle is to be markedly greater than 0°, but in any case less than 90°.

This angle is preferably between 2° and 15°.

Ends reshaped in such a way are stable as regards their upside-down stability even at increased internal pressure even though they do not have to miss the advantage of the more accurate vertical orientation of the inner leg.

For the accurate centering of the end, a ring holder finger-like in cross-section may be used for engaging in centering fashion the U-shaped groove during the coining step without deforming forces being exerted on the core groove in this case.

However, such a finger-like ring tool may be used to exert a controlled stretching pressure approximately in parallel with the end axis on the bottom of the core groove either at the same time or during the last phase of the coining step—displacing the material outwardly—, so that the flow of material radially outwardly via the radius of curvature is supported and simultaneously the inner leg of the U-shaped groove is tightened and brought more accurately into the desired vertical position.

According to the invention the material of the end sheet is compressed in the region of the annular fringe such that in this annular fringe region the sheet thickness reduction constantly decreases from a point of smallest residual thickness in radially outward direction. Within the deformed region, the residual thickness therefore changes radially outwardly e.g. in the form of a straight wedge, the bottom side being positioned in a plane extending perpendicularly to the end axis and the top side being positioned on a straight conical surface.

It proved to be especially advantageous to add a second treatment step to the described first further treatment step. During the second treatment step, the end material is slightly levelled in the fringe-like region—squeezed and deformed in the first step—, however, without displacing the material noticeably. But this is only done in a section, namely a radially outer region of the fringe, which adjoins the radius of curvature. This results in another reduction of the radius of curvature', which contributes essentially to the increase in the lug resistance of the end. If owing to the first coining an insignificant portion of the displaced material was still displaced radially inwardly, the second treatment step would level the possibly resulting minor "doming" of the central panel portion and creates substantially the accurate abutment of the radially inner wall of the core groove against the lower forming tool. The radially inner "barrier" strain-hardened owing to the wedge effect already and the levelling effect of the tool avoid during levelling that another material portion is displaced from a local region or even shifted inwardly (past the strain-hardened "barrier").

Correspondingly, the levelling step only performs strictly geometrical formation work which concerns the improved orientation of the inner leg of the core groove.

U.S. Pat. No. 4,354,784 (Westphal), which introduces a chip-free indented line into a metallic end, deals with an objective differing from that of the invention. This indented line circulates closely to the vertical core wall of the end and is made by a tool which has a central flat region and two inclined outer regions (col. 4, first para. thereof). By means of this "trapezoidal tool" an indented-line contour is obtained which reduces the danger of metal chips when tearing open. This freedom from chips is obtained while determining the indented line by a simultaneous displacement of material from the central portion towards both sides (radially inwardly and radially outwardly) . An only one-sided displacement of material is not effected by this tool.

A roughly comparable objective—the protection of children's tongues from the danger of cutting—is inherent in DE-A-23 03 943. It wants to avoid that children's tongues are exposed to the danger of cutting when they lick off the thick pudding layer on the bottom side of the end. For this purpose, an S-like triple protecting fold is proposed which also circulates and is obtained by folding an initially vertical wall section. In a preliminary step of this folding process a tool member is used (evident by means of FIG. 14) which has an annular undercut and a protruding planar annular surface which in a zone (referred to as 45 therein) achieves a reduction of the material thickness of the metal end. The material displaced radially inwardly from said zone by this coining step leads to a change of the inclination of said vertical wall section which subsequently forms the S-shaped protecting fold. A displacement of material only radially outwardly is neither proposed nor suggested herein.

The invention is explained in more detail on the basis of the appending diagrammatic drawings by means of several embodiments.

DETAILED DESCRIPTION OF THE PREFERRED EMBODIMENTS

Figure 1:
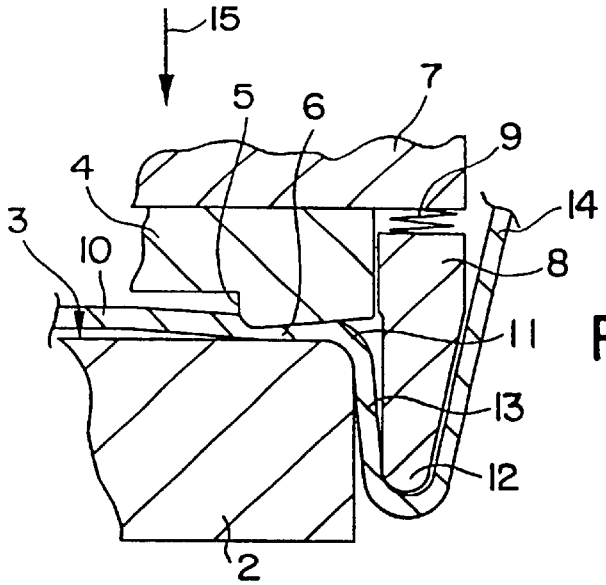
FIG. 1 shows in detail and in a perpendicular section containing axis 16 of the end the tools required for carrying out the process at the end of the further treatment of a corresponding sheet end.

The end 1 is formed as usual from a round sheet plate such that it has a slightly curved central panel portion 10 which changes via a radius of curvature 11, R1 into the straight inner leg 13 of a groove 12 U-shaped in cross-section, whose outer leg 14 forms the core wall of the end which (not shown) is adjoined by the end edge. The edge may be developed in any fashion and typically be a folded edge.

The thus preshaped end is placed between the coining tools 2 and 4. Coining tool 2 has a coining surface 3 extending approximately perpendicularly to the end axis 16. On its bottom side in the outer region, the coining tool 4 movable relative to the coining tool 2 as according to arrow 15 has an annular rib formed by a step 5, whose coining-effective bottom side 6 forms a predetermined angle 0.25 relative to the coining surface 3 of tool 2, which angle is markedly greater than 0° and less than 90° and preferably between about 2° and 15°. The coining tool 4, 5 is supported against a die 7 against which in the example shown an annular holding-down device 8 is supported via a spring 9, which is finger-like in cross-section and engages in centering fashion the U-shaped groove 12 of the end.

FIG. 1 shows the coining tools in a position which they adopt at the end of the squeezing or coining process.

Owing to this further treatment of the end, the material of the central panel portion 10 of the sheet end is squeezed in an annular fringe region 20 which adjoins radially inwardly the R1 curvature 11. In this case, the curvature 11 itself is largely spared from the squeezing operation but not from its effects as regards the outwardly displaced material. The material displaced during squeezing flows in controlled fashion radially outwardly and via the curvature 11 into the inner leg 13, to be oriented, of groove 12.

Figure 3:
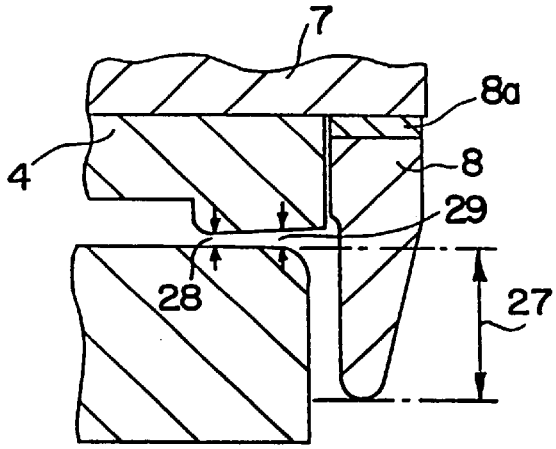
FIG. 3 shows a modified embodiment of the tool for a modified process example.

Owing to this development, the least residual thickness is obtained at a distance, exceeding the fringe width 24, from the curvature 11, which thickness is outlined in the tool position according to FIG. 3 at 28. It may be 65%, for example. The thickness reduction decreases radially outwardly, preferably along 22 in uniform and constant fashion, so that the residual thickness 29 changes radially outwardly in substantially step-free manner into the normal thickness of the sheet in the region of curvature 11.

The flowing step is even promoted when the holding-down device 8 is supported via portion 8*a* rigidly against the die 7, the axial length 27 of the centering finger 8 being dimensioned such that at the end of the coining step a predetermined pressure is exerted upon the bottom 12 of the groove via the finger. As a result, the flow of material from the fringe region 20 through the curvature 11 is even promoted considerably and the radially inner straight leg 13 of the U-shaped groove 12 is simultaneously kept under yield stress and oriented.

Figure 4:
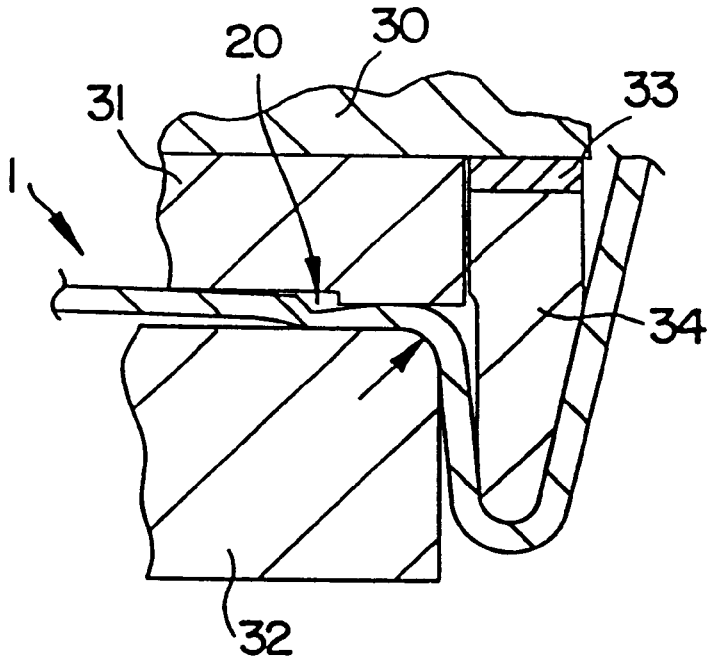
FIG. 4 shows the tools for another process step following the further treatment step of FIG. 1 or FIG. 3.

The deformation resistance of the edge profile can even be enlarged considerably, and the lug resistance can be increased when the above-described treatment step (coining) according to FIG. 1 or 3 is followed by a second treatment step (levelling) according to FIG. 4. Here, tools similar to those used in the first treatment step are employed, but the upper coining die 31 has a coining rib whose effective levelling surface extends substantially perpendicularly to the end axis 16, so that during levelling the material is shaped geometrically between two planes and coining surfaces extending perpendicularly to the end axis 16.

However, this levelling is confined to only part of the fringe which was squeezed beforehand, namely to the portion which adjoins the curvature and has the greatest residual thickness (e.g. between 100% and 70%) The coining tool 31 is supported against the die 30 against which the centering tool 34, finger-like in cross-section, may also be supported directly via part 33, as shown in FIG. 4. The stretching effect of tool 34 is equal to the effect of tool 8 according to FIG. 3.

Figure 2:
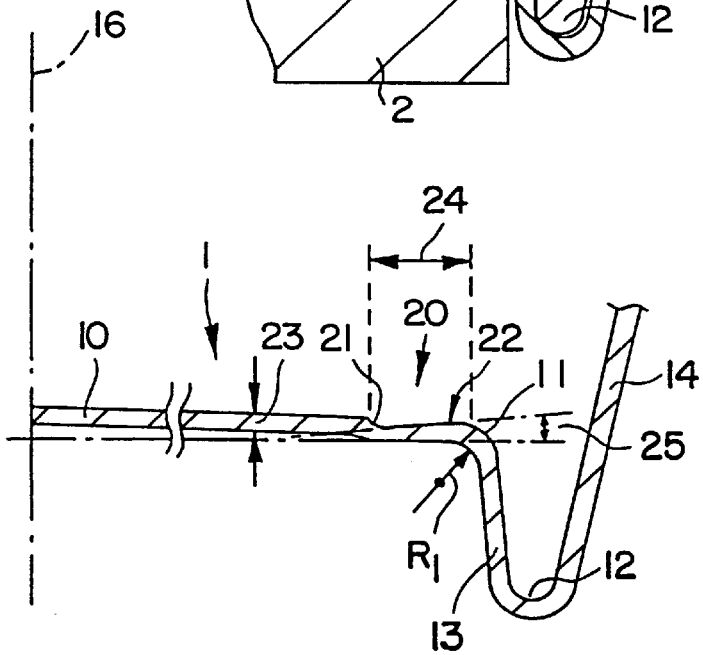
FIG. 2 shows the sheet end further treated according to the invention in a similar illustration as in FIG. 1.

During this levelling the radius R2 of curvature 11 is reduced as compared to the radius R1 according to FIG. 2. The reduction of the radius of curvature' and the geometrical post-shaping of the squeezed region result in an increase in lug resistance by clean outlining of the edge profile without additional material solidification.

Figure 5:
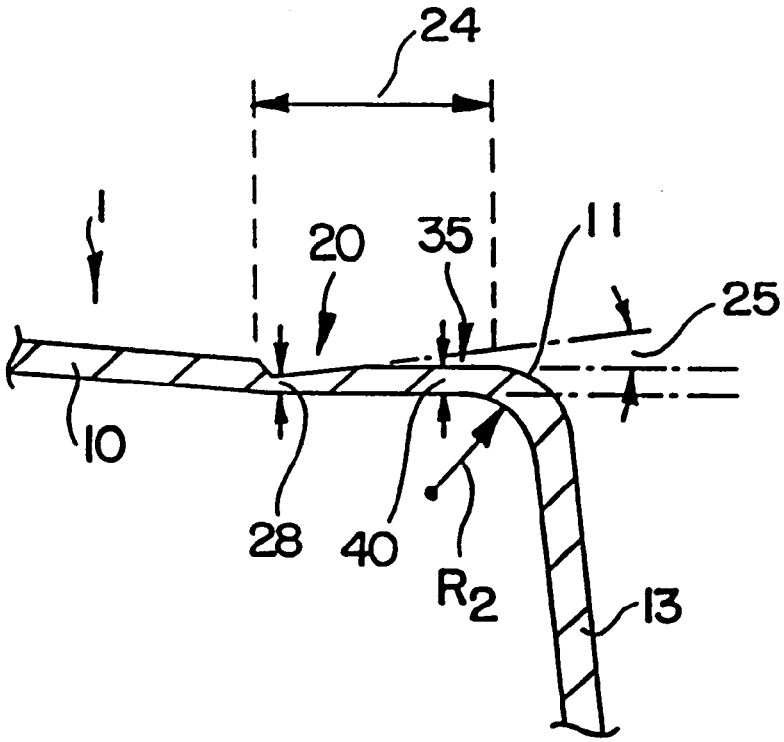
FIG. 5 shows in similar representation as in FIG. 2 an end which has been treated with the two process steps according to FIG. 1 and FIG. 4.

The original residual thickness of the sheet within the radially outer region of the fringe—as indicated at 29 in FIG. 3—is reduced only insignificantly at 40, but it is shaped geometrically. The outer surface originally extending conically over the entire width 24 of the fringe 20 is shaped by the deformation in a region 35 which is smaller than the width of fringe 24 and is perpendicular to the end axis 16. The rest of fringe 24 retains its inclination corresponding to angle 25 from the first coining step. The centering during the second step according to FIG. 5 may be made according to FIG. 1, i.e. with spring-suspended centering tool. However, a centering tool according to FIG. 4 is preferred, by means of which the leg 13 of the U-shaped groove 12 can be exposed to yield stress.

What is claimed is:

1. Strengthened can end having a central panel portion, comprising (a) a circular portion punched out of a planar sheet, said circular portion having an axis and an edge portion, said circular portion being shaped between form tools, thereby forming a circumferential groove in the edge portion, said circumferential groove having an inner wall leading through a radius of curvature into the central panel portion, (b) an annular fringe region in the central panel portion, said annular fringe region being positioned radially inside the radius of curvature and having a sheet thickness reduction constantly decreasing from a point of lowest residual thickness in radially outward direction towards the radius of curvature and having a step portion at a radially inner end of the sheet thickness reduction for strengthening the annular fringe region, reducing bulging of the central panel portion and improving orientation of the inner wall of the circumferential groove in the edge portion of the can end.

2. Can end according to claim 1, wherein a slope of a sheet thickness increase resulting from said constantly decreasing sheet thickness reduction is substantially linear.

3. Can end according to claim 1, wherein an angle of inclination of said sheet thickness increase resulting from said decreasing of said sheet thickness reduction is between 2° and 15°.

4. Can end according to claim 1, wherein the point of lowest residual thickness is substantially 65% of a sheet thickness of the punched out circular portion.

5. Can end according to claim 1, wherein an outer portion of said fringe region being leveled to have a substantially flat surface of annular shape, surrounding a remainder of the fringe region.

6. Can end according to claim 1, having a surface on an opposite face of said fringe region, said surface being substantially flat.

7. Can end according to claim 1, wherein the point of lowest residual thickness provides a strain hardened barrier.

8. Can end according to claim 1, wherein said step portion has a substantially abrupt change in thickness compared to a slope of a sheet thickness increase towards the radius of curvature.

9. Can end according to claim 5, wherein the substantially flat surface of annular shape extends in radial direction in at least a part of a radially extending segment, having its inner end at 70% and its outer end at 100% of axial sheet thickness, when compared to a sheet thickness of said punched out circular portion.

10. Metallic can end having a circumferential groove and a central panel and comprising (i) a circular portion punched out of a planar sheet, said circular portion having an axis and an edge portion, said circular portion being shaped between an upper and a lower form tool, thereby forming said circumferential groove in the edge portion, said groove having an inner wall leading through a radius of curvature into the central panel;

(ii) an annular fringe region as a part of the central panel portion and adjoining the radius of curvature, said fringe region having a sheet thickness, increasing from a point of lowest residual thickness in radially outward direction towards the radius of curvature and having a step portion at a radially inner end of the fringe region for reducing bulging of the central panel and improving orientation of the inner wall of the circumferential groove of the can end.

11. Can end according to claim 10, said step portion having a substantially abrupt change in thickness compared to a slope of the sheet thickness increase towards the radius of curvature.

* * * * *